United States Patent [19]

Bellino et al.

[11] Patent Number: 4,999,464

[45] Date of Patent: Mar. 12, 1991

[54] MOLDED CASE CIRCUIT BREAKER CONTACT AND CONTACT ARM ARRANGEMENT

[75] Inventors: Joseph P. Bellino, West Simsbury; David Arnold, Chester; Dexter T. O'Brien, Simsbury; Ira B. Goldman, Waterbury, all of Conn.

[73] Assignee: General Electric Company, New York, N.Y.

[21] Appl. No.: 498,777

[22] Filed: Mar. 23, 1990

[51] Int. Cl.[5] ..... H01H 1/02

[52] U.S. Cl. ..... 200/267; 200/401; 200/268; 200/269; 200/271; 200/275

[58] Field of Search ..... 200/401, 275, 271, 272, 200/273, 274, 267, 268, 269

[56] References Cited

U.S. PATENT DOCUMENTS

| | | | |
|---|---|---|---|
| 1,904,241 | 4/1933 | Kammerer | 200/269 X |
| 3,686,456 | 8/1972 | Talento . | |
| 3,778,576 | 12/1973 | Anderson et al. | 200/268 X |
| 4,374,311 | 2/1983 | Okahashi et al. | 200/269 |
| 4,375,021 | 2/1983 | Pardini et al. | 200/147 B |
| 4,503,191 | 3/1983 | Baudrand | 200/268 X |
| 4,645,891 | 2/1987 | Changle | 200/401 |
| 4,733,033 | 3/1988 | Morris et al. . | |
| 4,733,211 | 3/1988 | Castonguay et al. | 335/192 |
| 4,736,174 | 4/1988 | Castonguay et al. | 335/167 |
| 4,757,294 | 7/1988 | Todaro et al. | 335/202 |
| 4,782,583 | 11/1988 | Castonguay et al. | 29/622 |
| 4,789,848 | 12/1988 | Castonguay et al. | 335/167 |

FOREIGN PATENT DOCUMENTS

| | | | |
|---|---|---|---|
| 227214 | 7/1959 | Australia | 200/268 |
| 31159 | 7/1981 | European Pat. Off. | 200/268 |
| 2403048 | 7/1975 | Fed. Rep. of Germany | 200/269 |
| 38936 | 2/1989 | Japan | 200/269 |
| 2080039 | 1/1982 | United Kingdom | 200/269 |

*Primary Examiner*—Ernest G. Cusick

*Attorney, Agent, or Firm*—Richard A. Menelly; Walter C. Bernkopf; Fred Jacob

[57] ABSTRACT

A molded case circuit breaker movable contact arm electrically connects with the circuit breaker load terminal requiring only a small diameter auxiliary electrical conducting braid by pivotally arranging the contact arm within its support. The contact arm is nickel-plated prior to attachment of the contact to insure high current circuit interruption withtout damage to the contact or the contact arm.

10 Claims, 3 Drawing Sheets

MOLDED CASE CIRCUIT BREAKER CONTACT AND CONTACT ARM ARRANGEMENT

BACKGROUND OF THE INVENTION

When utilizing high speed current limiting circuit interruption to interrupt the circuit current in the early stages of the current waveform, it is important that the movable contact arm size be as small as possible to promote electrodynamic repulsion. A further approach to improving the dynamics of contact arm repulsion is to eliminate the heavy flexible braid conductor that connects the contact arm to the load terminal.

U.S. patent application Ser. No. 327,655 entitled "Molded Case Circuit Breaker Movable Contact Arm Arrangement" describes a "braidless" connection between the movable contact arm and its support which does not require any flexible braid conductor and which is of a small size to promote electrodynamic repulsion. This Application is incorporated herein for reference purposes and should be reviewed for its detailed description of the movable contact arm support. When current limiting circuit interrupters are used within higher ampere rated circuits, a small auxiliary flexible conductor is used to provide a parallel current path to deter pitting and such other corrosive electrical effects from occurring at the contact arm-contact support interface.

One example of a silver impregnated-tungsten carbide contact for circuit interrupters is found within U.S. Pat. No. 3,686,456 which Patent is incorporated herein for reference purposes. When such a contact is welded or brazed to the copper movable contact arm, a flux material containing an acid compound is used to provide a clean interface surface for good electrical and thermal transfer between the silver-tungsten carbide and the copper materials. At the interface between the contact and the contact arm, a eutectic alloy of silver and copper is formed having a melting point lower than that of the copper and the silver.

A further example of a braidless movable contact arm is found in U.S. Pat. No. 4,733,033, which Patent is incorporated herein for reference purposes. This Patent discloses the use of a spring having a planar configuration capable of holding the contact arm against its support posts with sufficient force to maintain electrical contact during overcurrent conditions. When this design is used within higher ampere-rated current limiting industrial circuit breakers, a parallel current path should be connected between the movable contact arms and the contact arm support posts to prevent the occurrence of arcing between the contact arm and the support posts under intense short-circuit overcurrent conditions.

With prior art noncurrent-limiting movable contact arms containing flexible braid conductors, the larger mass of copper material constituting the contact arm provided adequate "heat sink" capacity to the silver-tungsten contacts such that when the contacts are subjected to intense short circuit test conditions, the contacts remain at a temperature lower than the melting temperature of the eutectic alloy. With current-limiting movable contact arms it is important to maintain attachment between the contact and the contact arm after multiple short circuit interruptions. The eutectic alloys, that do not present a problem with larger contact arms because the short circuit interruption temperatures are moderated by the larger "effective" heat capacity of the contact arm, could be problematic within smaller-sized circuit interrupters in that the temperatures generated under extreme short circuit test conditions could momentarily exceed the eutectic melting point.

One purpose of the instant invention accordingly is to provide a current-limiting copper contact arm that does not generate a silver-copper eutectic alloy upon attachment of the silver-impregnated tungsten carbide contact.

SUMMARY OF THE INVENTION

A molded case circuit breaker copper contact arm is mechanically and electrically connected to a terminal support by means of a pair of support posts and an auxiliary contact braid is connected between the contact arm and the support post to provide a parallel current path for higher-ampere ratings. An interface nickel coating is applied to the contact arm to prevent the silver in the contact and the copper in the contact arm from mixing and alloying with each other when the silver-impregnated contact is welded or brazed to the copper contact arm.

DESCRIPTION OF THE PREFERRED EMBODIMENT

Figure 1:
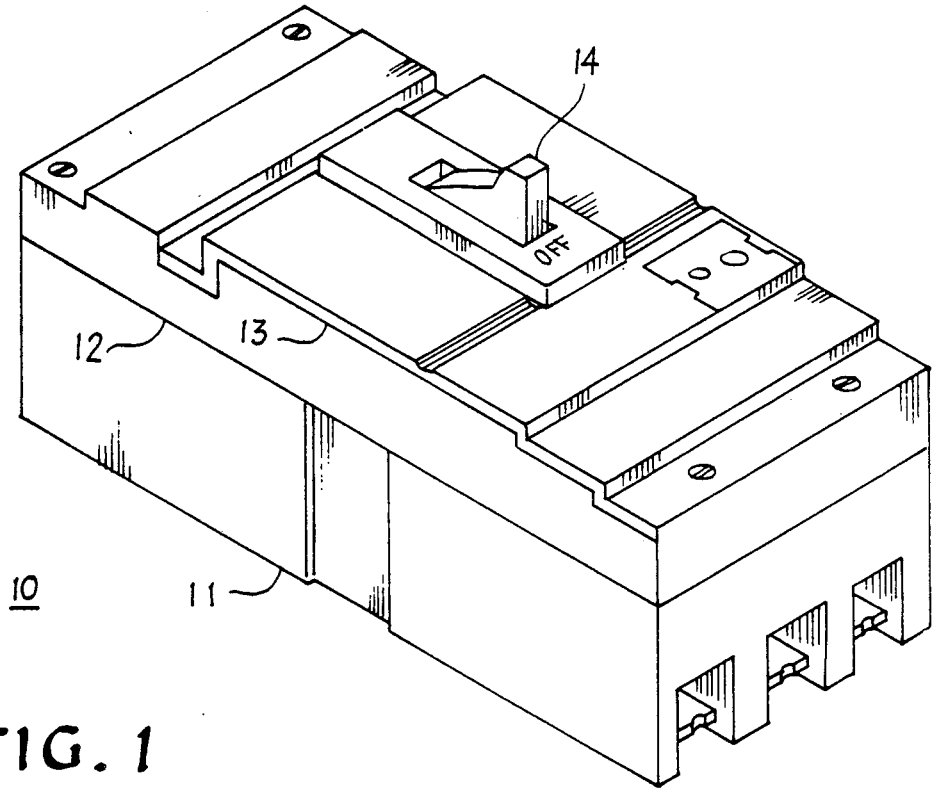
FIG. 1 is a top perspective view of a molded case circuit breaker including the movable contact and contact arm arrangement in accordance with the invention.
Figure 2:
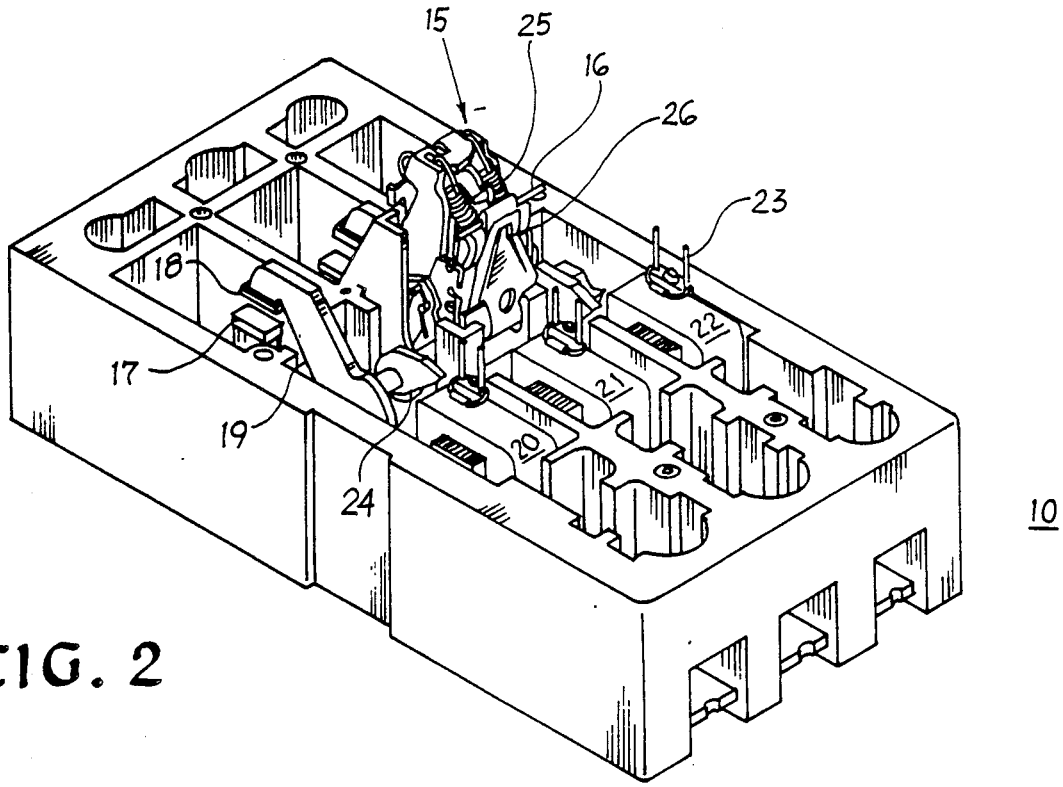
FIG. 2 is a top perspective view of the molded case circuit breaker of FIG. 1 with the cover removed to depict the circuit breaker operating mechanism assembly.

A current limiting circuit breaker 10 is depicted in FIG. 1 and consists of a case 11 to which a cover 12 is attached and which further includes an accessory cover 13. A circuit breaker operating handle 14 extends upward from a slot formed within the circuit breaker cover for manual intervention to turn the circuit breaker to its ON and OFF conditions. As described in U.S. Pat. No. 4,757,294, an actuator unit (not shown) interfaces with an operating mechanism 15 by means of a trip bar 16 to separate the circuit breaker fixed and movable contacts 17, 18, best seen by referring now to FIG. 2. The operating mechanism acts upon the movable contact arm 19 to drive the movable contact arm to the open position, shown in the circuit breaker 10 depicted in FIG. 2, upon the occurrence of overcurrent conditions of a predetermined magnitude. The circuit current is sensed by means of current transformers 20-22 which connect with the circuit breaker trip unit by means of upstanding pins as indicated at 23. A molded plastic crossbar arrangement 24 such as described in U.S. Pat. Nos. 4,733,211 and 4,782,583, which Patents are incorporated herein for reference purposes, insures that the movable contact arms operate in unison when the operating mechanism is articulated. The operating mechanism is held against the bias of a pair of powerful operating springs 25 by means of a latch assembly 26, such as described in U.S. Pat. No. 4,736,174 and 4,789,848, which Patents are also incorporated herein for reference purposes. In order to provide the current limiting functions described earlier, the movable contact arms are adapted for independent movement from the crossbar assembly by electrodynamic repulsion acting on the movable contact arm itself. One such example of a current limiting circuit breaker is found within U.S. Pat. No. 4,375,021, which is incorporated herein for reference purposes and should be reviewed for its teachings of electrodynamic repulsion of a movable contact arm under intense overcurrent conditions through the circuit breaker contacts.

When such intense overcurrent conditions occur, it is important that the movable contact arms maintain good electrical contact with the contact arm supports while the movable contacts move away from the fixed contacts. The movable contact assembly 27 shown in FIG. 3 improves over the braidless movable contact arm described within the aforementioned U.S. Pat. No. 4,733,033 and over that described within aforementioned U.S. patent application Ser. No. 327,655 by the addition of a pair of shunt plates 28, arranged on either side of the movable contact arm as well as the parallel braided shunt conductor 29. The shunt conductor is welded or brazed to the movable contact arm 19 at one end and is similarly attached to the contact arm support 30 at the opposite end. The movable contact arm includes a central body part through which a thru-hole 31 is formed and an extended forward part 32 to the end of which the movable contact 18 is attached by the method to be described below in greater detail. As described in the aforementioned U.S. patent application Ser. No. 327,655 the movable contact arm is positioned within the circuit breaker case by means of a support base 33 which includes integrally-formed upstanding support arms 34, 35. The base is tempered in order for the support arms to resiliently capture the movable contact arm in a tight press-fit relation to promote good electrical conduction between the support arms and the movable contact arm. A thru-hole 36 formed within the support base allows for the electrical connection of the support base with the circuit breaker load strap (not shown). The provision of an elongated slot 37 within the support base intermediate the upstanding support arms allows for the flex of the support arms when the movable contact arm is inserted. When the movable contact arm is positioned within the support arms, the thru-hole 31 in the movable contact arm aligns with corresponding thru-holes 39 formed within the support arms. A pivot pin 40 is next inserted within the thru-holes 39 which are slightly oversized to permit rotation of the contact arm, and within thru-hole 31 in a press-fit relation. The clearance provided between the thru-holes 39 within the support arms and the ends of the pivot pin allows the movable contact arm to freely rotate within the support arms while maintaining good mechanical and electrical connection between the pivot pin and the movable contact arm. It is important to maintain good electrical contact between the pivot pin and the movable contact arm while the contact arm rotates between its closed and open position in order to deter local ionization and pitting between the contact arm and the pivot pin. The shunt plates which are formed of a conductive material, such as copper or aluminum alloys, are shaped to include bifurcated arms 41, 42 extending from an angled base 43. Openings 44 are formed within the bifurcated ends of the shunt plates for supporting the shunt plates on the ends of the pivot pin. A U-shaped contact spring 45 is next positioned over the shunt plates to further promote electrical connection between the shunt plates, support arms and the movable contact arm. Upon the occurrence of an intense overcurrent condition, such as a short circuit, the current path between the shunt plates and the pivot pin becomes divided between the bifurcated arms 41, 42. The resulting parallel current path through the bifurcated arms electrodynamically drives the bifurcated arms against the ends of the pivot pin to maintain good electrical contact under intense short circuit overcurrent conditions. The good electrical conduction between the contact arm, pivot pin and support arms insures that no localized arcing and pitting will occur. The shunt plates share the circuit current with the shunt braid conductor 29 such that no pitting occurs between the pivot pin 40, support arms 34, 35 and the movable contact arm 19 even under such intense short circuit conditions.

Figure 4:
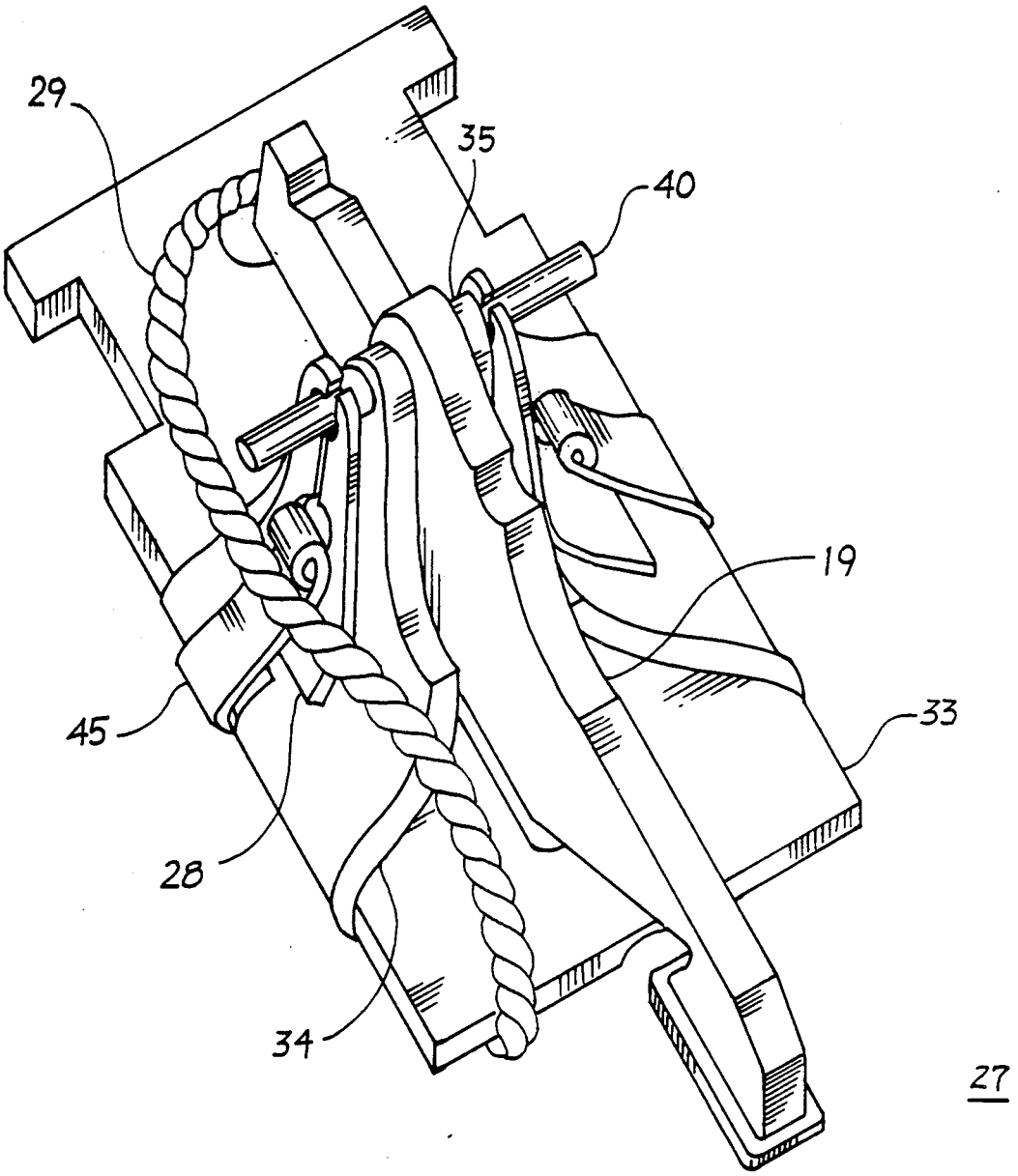
FIG. 4 is an enlarged top perspective view of the movable contact arm arrangement shown in FIG. 3.

The movable contact arm assembly 27 is depicted in FIG. 4 to show how the shunt plates 28 are forced against the support arms 34, 35, by the bias provided by the U-shaped contact spring 45. The pivot pin 40 is shown extending through the movable contact arm 19, the support arms and the shunt plates. Also depicted is the shunt braid conductor 29 which cooperates with the shunt plates to provide parallel current paths between the movable contact arm and the support 33 as described earlier.

In accordance with the further teachings of this invention, the movable contact arm 19 is first plated with a coating of nickel in order to prevent any silver from transferring from the movable contact to the movable contact arm during the welding operation. The nickel interface between the copper movable contact arm and the silver impregnated tungsten-carbide contact increases the temperature at which the contact attaches to the contact arm due to the higher melting point of the nickel than that of copper. The nickel coating thereby prevents the formation of a copper-silver eutectic and thereby substantially increases the temperature at which the contact would loosen and become detached from the movable contact arm. An acid flux is used to provide clean metallic surfaces during the welding or brazing operation. In some high current circuit applications, it is helpful to nickel plate the side of the contact that is welded to the contact arm and thereby promote a nickel to nickel weld. In other circuits, coating the surface of the contact alone is sufficient to deter the transfer of silver out from the tungsten carbide matrix such that the copper movable contact arm is not nickel plated. When the contact arm is nickel plated, it is immersed in either an electroless or electrolytic nickel plating solution in which the nickel is applied to a minimum thickness of 0.1/1000 of an inch.

When electrolytic nickel plating solutions such as nickel chloride and nickel sulfamate are employed, electrodeposited nickel coatings having good tensile strength are obtained. Other methods of depositing nickel to selected regions of the contact arm, such as plasma spray and vapor deposition techniques, can be employed in high speed manufacturing processes.

Figure 3:
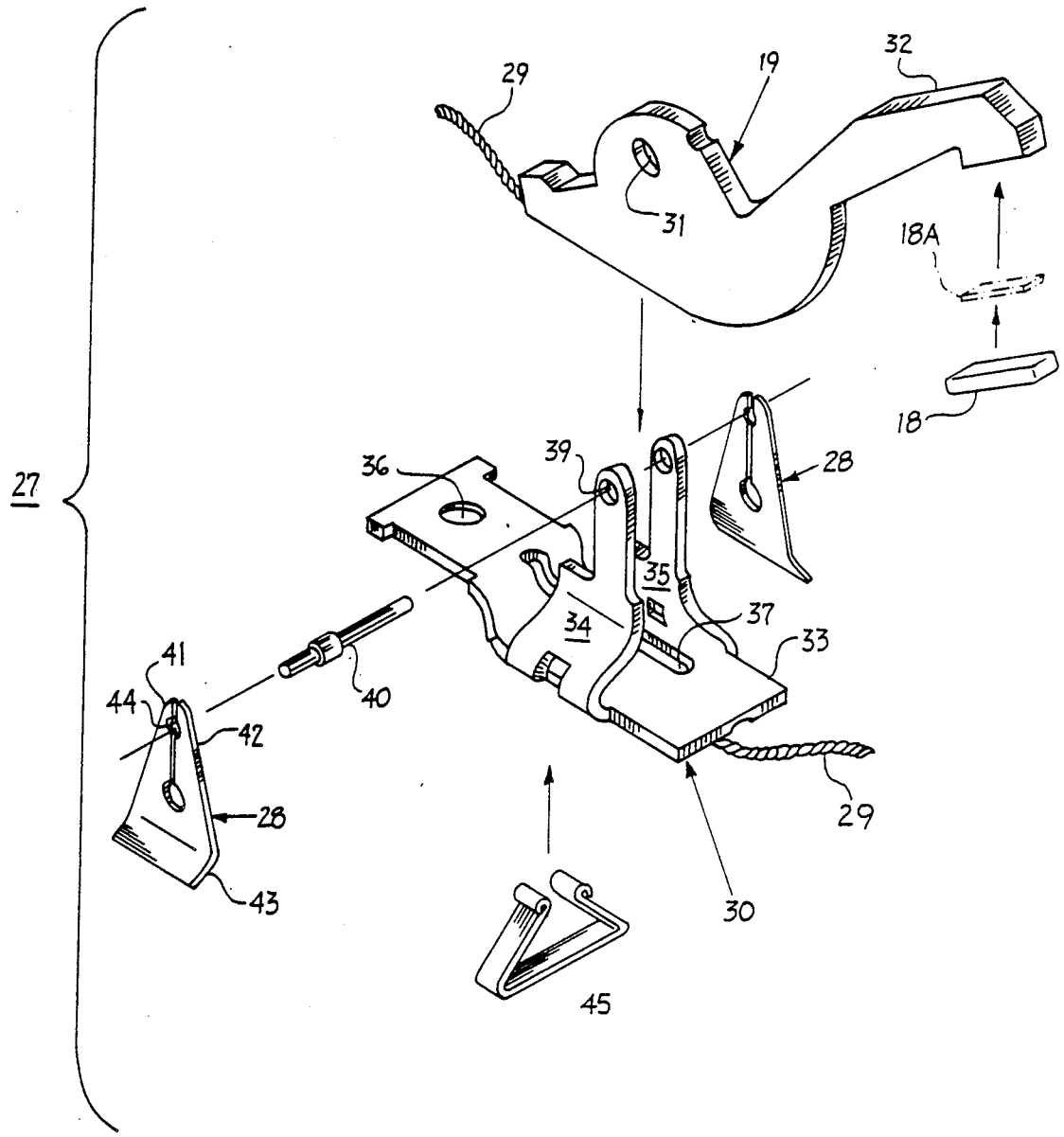
FIG. 3 is a top perspective view, in isometric projection, of the movable contact and contact arm assembly used within the circuit breaker depicted in FIG. 1.

In the event that neither the contact nor the contact arm is nickel plated, a thin disc of nickel or an alloy of nickel as indicated at 18A in phantom in FIG. 3 is interposed between the silver impregnated tungsten-carbide contact and the copper contact arm to deter the formation of the silver-copper eutectic.

Having thus described our invention, what we claim as new and desire to secure by Letters Patent is:

1. A molded case circuit breaker contact and contact arm arrangement comprising:

an elongated movable copper contact arm having a silver-impregnated contact attached to one end and a thru-hole arranged through said contact arm intermediate said one end and an opposite end;

a support comprising a pair of apertured upstanding support arms extending from a support base;

a pivot pin extending through said apertured support arms and said thru-hole electrically and mechanically attaching said contact arm to said support arms and providing rotation of said contact arm between closed and open positions; and nickel metal arranged intermediate said copper contact arm and said silver-impregnated contact thereby preventing intermixing between said silver and said copper when said contact is attached to said contact arm.

2. The arrangement of claim 1 wherein said nickel metal is electrodeposited on said contact arm.

3. The arrangement of claim 1 including a flexible braid conductor attached to said opposite end of said contact and said support base arm providing a parallel electrical current path between said contact arm and said support base.

4. The arrangement of claim 1 wherein said contact is attached to said contact arm by welding or brazing.

5. The arrangement of claim 4 including an acid flux applied to said contact arm before attaching said contact.

6. The arrangement of claim 1 wherein said nickel is electrodeposited from a solution of nickel salts or compounds.

7. The arrangement of claim 1 wherein said nickel metal comprises a plate or disc.

8. The arrangement of claim 1 wherein said plate or disc is attached to said contact prior to attaching said contact to said contact arm.

9. The arrangement of claim 1 wherein said nickel metal comprises electroless nickel.

10. The arrangement of claim 1 wherein said nickel metal is applied by means of chemical vapor deposition or plasma spray.

* * * * *